US005919116A

United States Patent [19]

Edell

[11] Patent Number: 5,919,116

[45] Date of Patent: Jul. 6, 1999

[54] EXERCISING DEVICE FOR FACIAL MUSCLES AND MOUTH

[75] Inventor: Drew Edell, Little Falls, N.J.

[73] Assignee: CCA Industries, Inc., East Rutherford, N.J.

[21] Appl. No.: 08/864,059

[22] Filed: May 27, 1997

[51] Int. Cl.[6] ..... A63B 23/03

[52] U.S. Cl. ..... 482/11; 482/124; 482/128; 601/38

[58] Field of Search ..... 482/11, 49, 122, 482/124, 126, 128; 600/201, 206, 237, 238, 242, 243; 433/140; 601/38; 606/204.15

[56] References Cited

U.S. PATENT DOCUMENTS

| | | | |
|---|---|---|---|
| 1,363,534 | 12/1920 | Rogers . | |
| 1,389,436 | 8/1921 | Cameron . | |
| 1,401,190 | 12/1921 | Risley | 600/237 |
| 1,714,029 | 5/1929 | Kuhn . | |
| 3,813,096 | 5/1974 | Welch . | |
| 3,938,508 | 2/1976 | Buckner . | |
| 4,280,696 | 7/1981 | Ramon . | |
| 4,671,260 | 6/1987 | Buckner . | |
| 4,744,556 | 5/1988 | Shaffer . | |
| 5,035,420 | 7/1991 | Beeuwkes, III et al. . | |
| 5,556,357 | 9/1996 | Hanna . | |

*Primary Examiner*—Richard J. Apley
*Assistant Examiner*—Victor K. Hwang
*Attorney, Agent, or Firm*—Fattibene & Fattibene; Arthur T. Fattibene; Paul A. Fattibene

[57] ABSTRACT

A facial muscle and mouth exerciser for maintaining the health, appearance, and flexibility of the facial and mouth muscles, and useful as a therapeutic device to prevent disfigurement of damaged tissues that may result from burns or cuts about the face and mouth, formed of two similar, all plastic molded components arranged in reciprocal sliding relationship for relative movement between an extended and retracted position whereby the relative movement of the components is normally biased toward the extended position and resisted toward the retracted position by an elastic band or spring resistant member.

7 Claims, 3 Drawing Sheets

EXERCISING DEVICE FOR FACIAL MUSCLES AND MOUTH

FIELD OF THE INVENTION

A facial and mouth exercising device and more specifically to a facial and mouth exercising device formed of substantially two identical molded components disposed in relatively sliding relationship to one another.

BACKGROUND OF THE INVENTION

Heretofore, various efforts have been made to develop a simple and economical facial exerciser for strengthening and/or enhancing the muscles about the face and mouth. A number of such facial exercisers are known and have been made the subject of several U.S. Letters Pat. Nos., e.g. 1,363,534; 1,389,436; 1,714,029; 3,813,096; 3,938,508; 4,280,696; 4,671,260; 4,744,556; 5,035,420; and 5,556,357. While the foregoing noted patented exercisers may be useful for their intended purposes, they are relatively complex, cumbersome and/or relatively difficult to fabricate.

SUMMARY OF THE INVENTION

An object of this invention is to provide for a relatively simply constructed facial exerciser having a minimum of component parts which can be readily assembled in a simple and expedient manner.

Another object is to provide a facial exerciser which comprises two similar component parts which are slidably interconnected for movement between an extended and retracted position whereby the respective components are normally biased toward their relative extended position and encountering a resistance when actuated toward the retracted position by an elastic or spring member.

Another object of the invention is to provide a facial exerciser formed of two similar components, each including a generally U-shaped end member integrally molded to the end of an associated slide shaft and a slide hub connected to the other end of the slide shaft, the slide hub having extended therethrough an offset bore for slidably receiving the slide shaft of the other complementary component.

Another object of the invention is to provide a facial exerciser wherein the respective components include integrally molded components.

Another object of this invention is to provide a facial exerciser formed of similar integrally molded components which may be biased by either an elastic resistance or a spring biased resistance.

The foregoing objects, features and other advantages of this invention are attained by a facial exerciser which includes a pair of similarly constructed components which may be formed entirely of plastic by injection molding. Each component includes an elongated slide shaft having integrally molded on one end a U-shaped facial holder, and a slide hub on the other end of the shaft. The slide hub includes a laterally offset bore extending therethrough, which is disposed generally parallel to its shaft of the component for receiving the shaft of a similarly formed complementary component. In the construction of the facial exerciser, the shaft and the slide hub on one end thereof is first injection molded of plastic as an integral member. The shaft and slide hub so formed is then assembled to a similarly formed complementary integral shaft and slide hub member by sliding the shaft of one component through the bore of the other component. With the two components thus assembled in relatively sliding relationship, the U-shaped end piece or facial holder is then injection molded directly onto the other end of the respective shafts. Upon completion of the molding operation, the two components are disposed in relatively sliding relationship to one another in a permanently interconnected sliding relationship between an extended position and a retracted position.

In one form of the invention, an elastic band or O-ring is looped around the adjacent slide hubs so that an elastic resistance is imparted on the slide hubs when the components are shifted to the retracted position and normally biasing the respective components toward the extended position.

In another form of the invention, a coil spring is disposed about the respective shafts to provide the necessary resistance and biasing means for components when moved between retracted and extended positions respectively.

IN THE DRAWINGS

DETAILED DESCRIPTION

Figure 1:
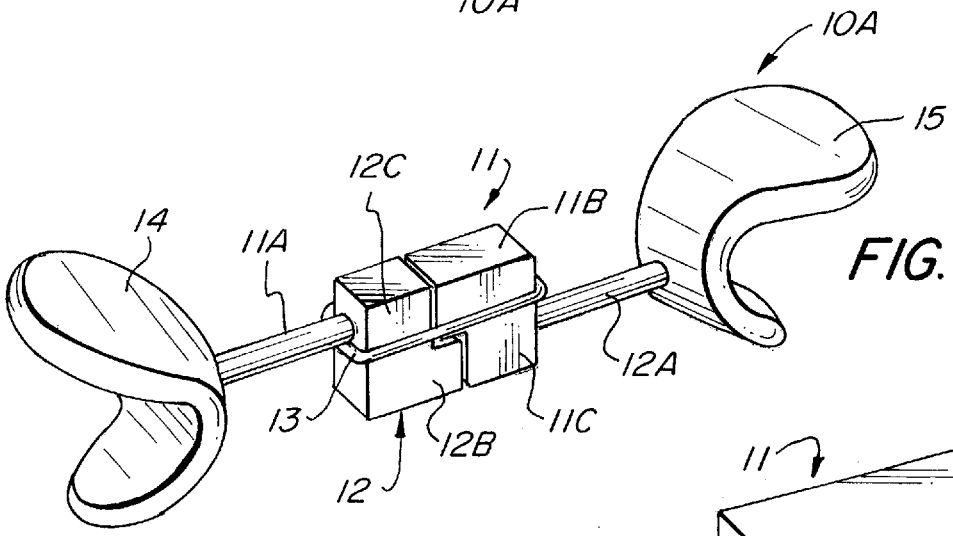
FIG. 1 is a perspective view of a facial exerciser embodying the invention.
Figure 3:
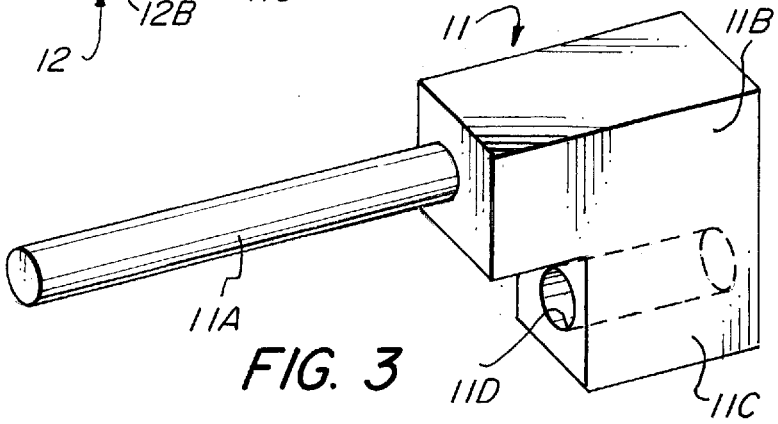
FIG. 3 is a perspective view of a component part of the facial exerciser of FIG. 1.
Figure 4:
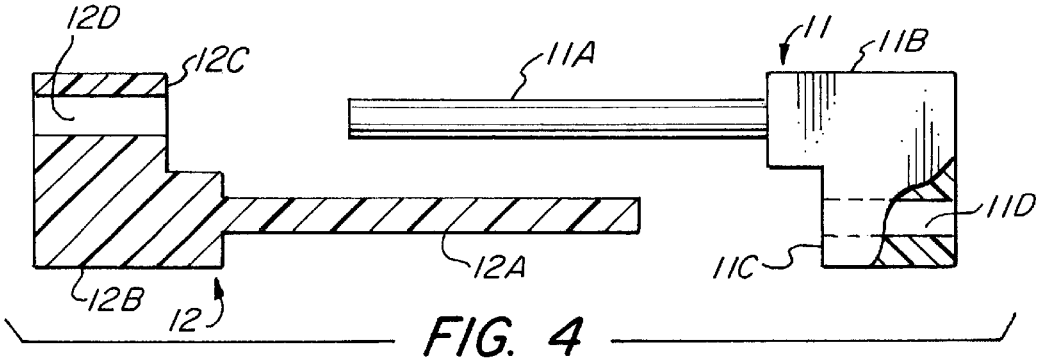
FIG. 4 is a side view of similar partially constructed components wherein one component is illustrated in section and the other having portions thereof broken away.
Figure 5:
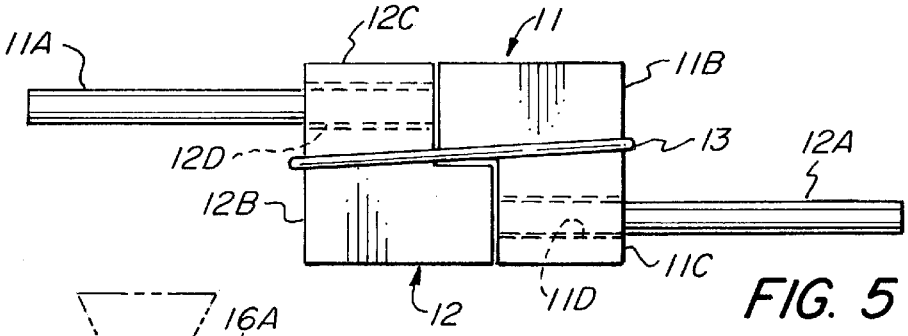
FIG. 5 is a partially assembled side view of the components of FIG. 1.

Referring to the drawings, FIGS. 1 to 7 illustrate one form of the invention. Shown in FIG. 1 is a facial exerciser 10A, for exercising the facial and mouth muscles, which is formed of two similarly constructed components 11 and 12 that are substantially identical. Each of the respective components 11 and 12 include an elongated shaft 11A, 12A having connected on one end thereof a slide hub 11B and 12B respectively. The respective slide hubs 11B, 12B have a laterally offset extension 11C, 12C respectively, and having a through bore 11D, 12D extending therethrough.

Figure 2:
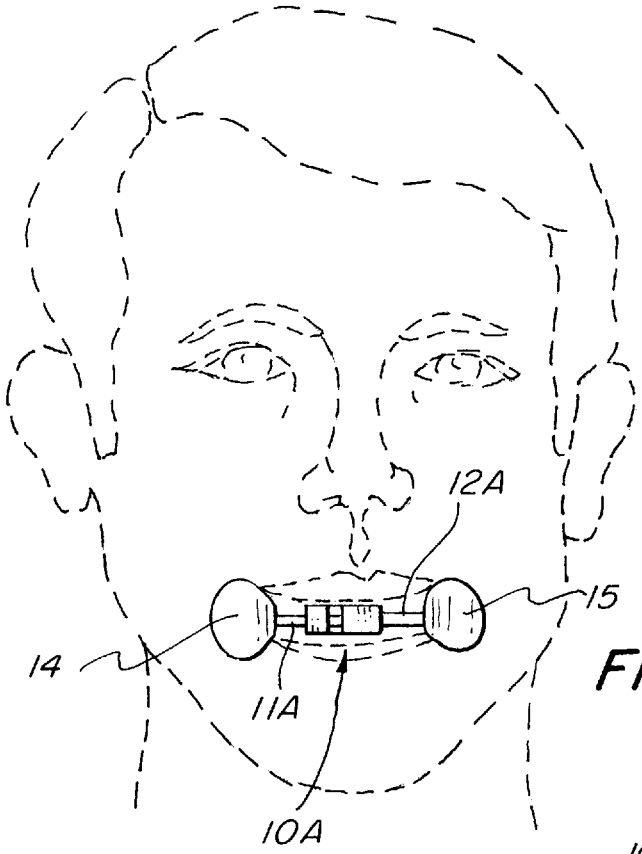
FIG. 2 is a diagrammatical showing the manner in which the facial exerciser is used.

To assemble the respective components 11 and 12, the shaft 11A of component 11 is slidably inserted through bore 12D of the other component 12, and shaft 12A slidably inserted through bore 11D of component 11, as shown in FIG. 2. With this arrangement, it will be noted that the slide hub of one component is slidably mounted on the shaft of the other component. The arrangement is such that the respective slide hubs are in sliding relationship with the associated shaft of the other component, whereby the respective components 11 and 12 are relatively movable between an extended position and a retracted position, as will be herein described.

Preferably, the respective components 11 and 12, as herein described, comprise an integrally molded member which may be readily formed by injection molding of a suitable plastic material. The arrangement is such that the respective components 11 and 12 are identical. As the components are identical, only one mold is required to mold the respective components 11 and 12, which is an important consideration in minimizing the cost of tooling required to fabricate the facial exerciser 10A.

Also, as shown in FIG. 1, the respective components 11 and 12 are biased by means of an elastic band or O-ring looped around the slide hubs which are free to expand within predetermined limits, as will be hereinafter described.

In accordance with this invention, a U-shaped end piece 14, 15 is connected to the other or free end of the respective shafts 11A and 12A. This is preferably attained by injection molding the end piece 14, 15 directly onto the free end of the respective shafts 11A, 12A. By injection molding the end piece 14, 15 directly onto the end of its respective shafts 11A, 12A, the entire component, including the shaft, slide hub and end piece is formed as an integral member.

Figure 6:
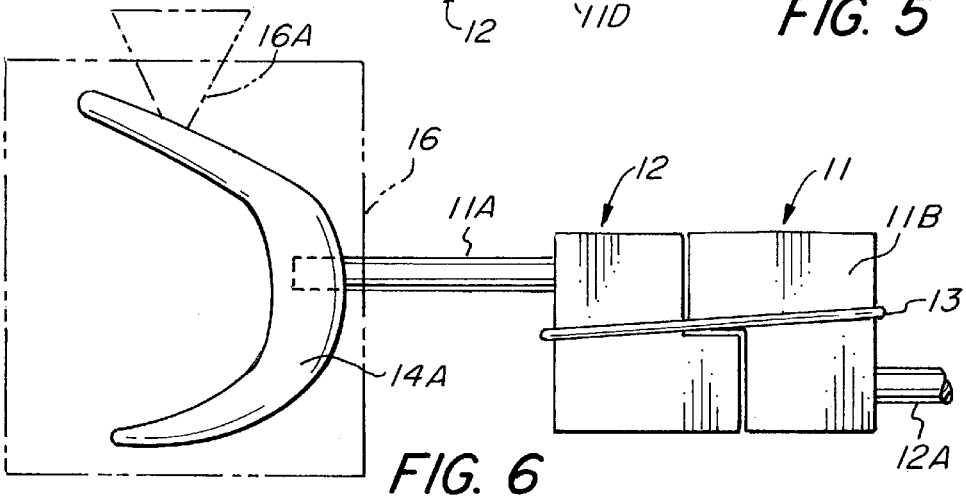
FIG. 6 is a partially assembled side view similar to FIG. 2 and diagrammatically illustrating the injection molding of the end or facial holder onto the shaft.

As shown in FIG. 6, the free end of the shaft, e.g. 11A, is inserted through a side opening in a mold 16 and into the mold cavity 14A which defines the shape of the end piece 14. It will be understood that when the molten plastic is injected into mold 16 through gate 16A, the end piece 14 is integrally formed about the end with its associated shaft 11A.

Figure 7:
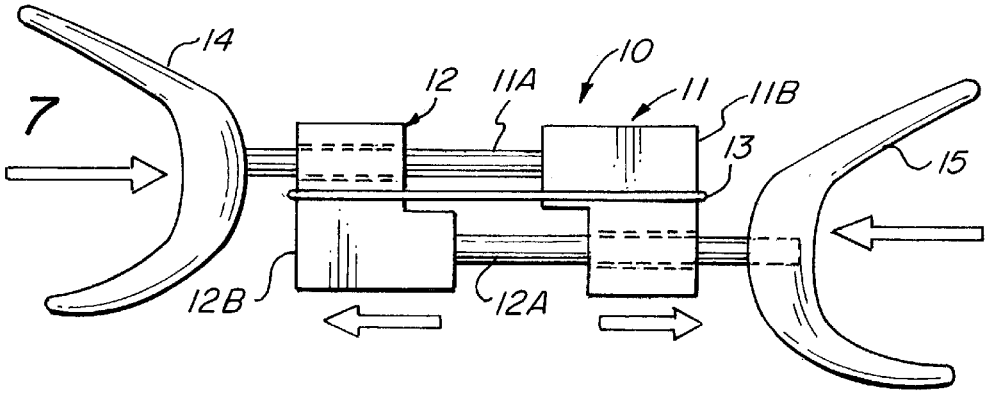
FIG. 7 is an assembly side view of a facial exerciser embodying the present invention.

Upon completion of the molding operation of the respective end pieces 14, 15, the two components 11 and 12 are thus interconnected for relative reciprocal movement toward and away from one another whereby the components are shifted between an extended position, as shown in FIG. 1, to a retracted position as shown in FIG. 7. The elastic band or elastic O-ring 13 thus functions to maintain the respective slide hubs biased toward their extended position as in FIG. 1 and imparts on said components a resistive force when the slide hubs are shifted toward the retracted position as shown in FIG. 7.

In operation, the facial exerciser 10A is horizontally positioned in the mouth so that the respective end pieces 14, 15 engage the opposed corners of the mouth as best shown in FIG. 2. By repeatedly opening and closing the mouth with the exerciser 10A in place, the respective components 11 and 12 are caused to slide relative to one another between an extended and retracted position as indicated by the arrows in FIG. 7. In doing so, the facial or mouth muscle must overcome the resistance imparted by the elastic band 13, and thus tends to strengthen or stretch the facial muscles to achieve the desired results. By varying the resistive force of the elastic or rubber band 13, the amount of force required to effect the retraction and extension of the facial exerciser can be varied.

Figure 8:
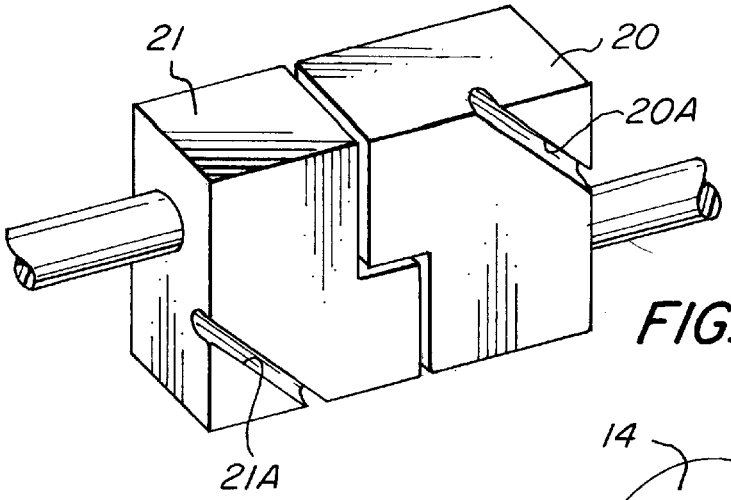
FIG. 8 is a partial perspective view of a slightly modified form of the invention.
Figure 9:
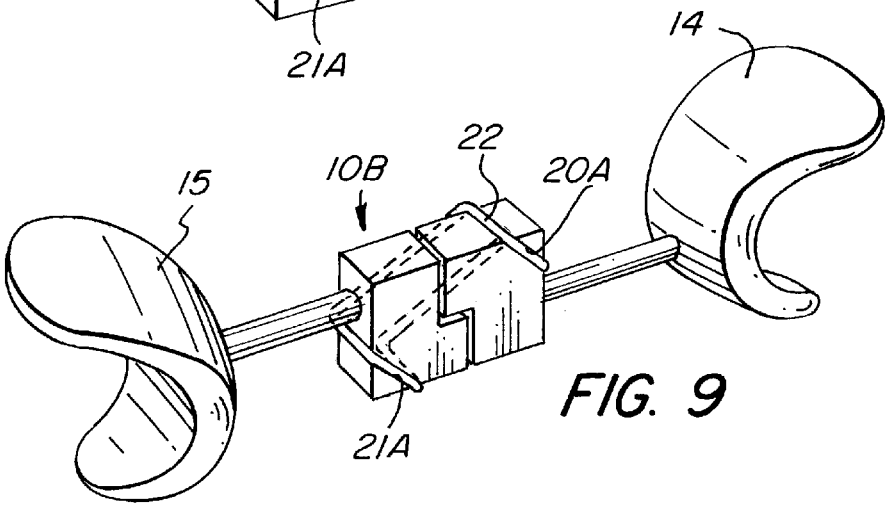
FIG. 9 is a perspective view of a modified form of the invention embodying the modified detail of FIG. 8.

FIGS. 8 and 9 are directed to a modified form of the invention. In this form of the invention, the facial exerciser 10B is identical to the facial exerciser of 10A except that the slide hubs 20, 21 are provided with a diagonal slot 20A, 21A adjacent the opposed corners to provide a seat for the elastic rubber band or O-ring 22, which is looped diagonally around the opposed corners of the slide hubs 20, 21 as shown in FIG. 9. In this modification, the elastic band 22 can be easily looped around the opposed diagonal corners of the slide hubs after the molding has been completed, whereby the band is retained in the diagonal slots 20A, 21A of slide hubs 20, 21 and insures holding the band 22 in place. In all other respects, the embodiment of FIG. 9 is similar to that of FIGS. 1 to 7.

Figure 10:
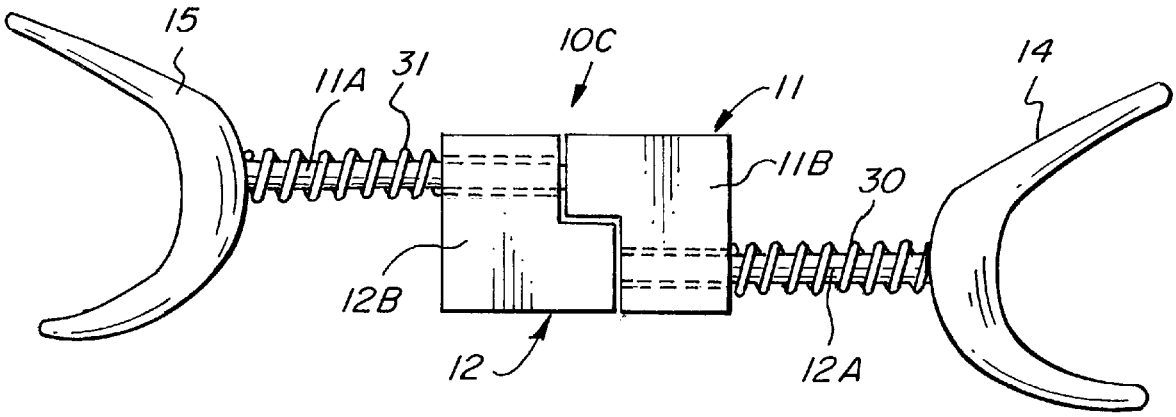
FIG. 10 is a side view of a further modified form of the invention.

FIG. 10 illustrates another form of the invention. In this form, the facial exerciser 10C is identical in structure and manner of making as described with respect to FIGS. 1 to 7, with the exception that in this embodiment, a pair of coil springs 30 and 31 are provided to impart the resistance and biasing force on the respective slide hubs. As shown, a coil spring 30 is disposed about shaft 12A so as to be rendered compressible between the slide hub 11B and the associated end piece 14. Coil spring 31 is coiled about shaft 11A and rendered compressible between the slide hub 12B and the associated end piece 15. In this form of the invention, coil springs 30, 31 impart the resistive and biasing forces on the slide hubs 11B, 12B in effecting the relative movement of the respective components 11 and 12 between and extended and retracted position. In all other respects, the operation, structure and function of the embodiment of FIG. 10 is similar to that described with respect to FIGS. 1 to 7 and 8, 9.

From the foregoing, it will be readily apparent that the described embodiments comprise essentially of two identical components which are interfitted to one another for movement between an extended and retracted position, and whereby the end pieces are molded in situ directly onto the end of its corresponding shaft to define an integrally molded part. With the arrangement described, either an elastic band or opposed coil springs can be used to impart the requisite resistive forces necessary to strengthen or stretch the desired facial muscles. Once assembled, the respective components 11 and 12 cannot become separated or lost, and are permanently secured in relative sliding relationship. The entire assembly can be injection molded for easy and economical assembly. The shafts 11A and 12A of the respective components may be formed of a suitably flexible plastic so as to impart a slight flexibility to the shaft 11A, 12A sufficient to conform to the slight curvature of the mouth, if necessary. Such flexibility or bowing of the respective shaft will also impart a resistive force which may further aid in effecting the strengthening and/or stretching of the facial or mouth muscles.

While the present invention has been described with respect to several embodiments, modifications and variations thereof may be made without departing from the spirit or scope of this invention.

What is claimed is:

1. A facial exercising device comprising:

two identical components, each of said components including an elongated shaft, a slide hub fixedly connected to one end of said elongated shaft, and a U-shaped end piece fixedly connected to the other end of said shaft, said slide hub having a through bore extending therethrough whereby said bore is laterally offset and substantially parallel to said shaft, said components being disposed in relative sliding relationship by the shaft of one of said components being slidably received in the bore of the slide hub connected to the other of said component for reciprocal movement between a retracted and extended position whereby said components are slidably secured and permanently interconnected to one another in the assembled position, and a means for imparting a resistive force on said slide hubs, wherein said means for imparting a resistive force comprises a coil spring disposed about each of said shafts extending between said hub and corresponding end piece for normally biasing said U-shape end pieces toward their extended position.

2. A facial exercising device comprising:

two identical components, each of said components including an elongated shaft, a slide hub fixedly connected to one end of said elongated shaft, and a U-shaped end piece fixedly connected to the other end of said shaft, said slide hub having a through bore extending therethrough whereby said bore is laterally offset and substantially parallel to said shaft, said components being disposed in relative sliding relationship by the shaft of one of said components being slidably received in the bore of the slide hub connected to the other of said component for reciprocal movement between a retracted and extended position whereby said components are slidably secured and permanently interconnected to one another in the assembled position, and a means for imparting a resistive force on said slide hubs, wherein said means for imparting a resistive force includes an elastic band looped about said slide hubs, each of said slide hubs including a laterally offset extension, said bore extending through said offset extension whereby said offset extensions are oppositely disposed so that said bores are disposed in parallel relationship so that said shafts extending therethrough are maintained in spaced apart parallel relationship, each of said slide hubs being generally rectangular in shape and said slide hubs having diagonally opposed corners, and said elastic band being looped about the opposed diagonal corners of said slide hubs.

3. A facial exerciser as defined in claim 2 wherein said slide hubs include a diagonal slot defining a seat for receiving and holding said elastic band looped about said opposed diagonal corners.

4. A facial and mouth muscle exerciser comprising:

a pair of identically formed components, each of said components including an elongated shaft, a slide hub connected to one end of said shaft, and a U-shaped end piece connected to the other end of said shaft, said slide hub being generally rectangular and having a reduced lateral extension directed to one side of said shaft, a through bore extending through said lateral extension, said bore being disposed in spaced parallel relationship to the longitudinal axis of said shaft whereby the shaft of one of said components is slidably received within the bore of the slide hub of the other of said components so that said pair of components are permanently secured to one another and reciprocally mounted relative to one another for movement between a retracted and extended position, and means for imparting a resistive force on said components to be overcome when shifted from the extended position to the retracted position, wherein said resistive means comprises an elastic band which is looped about said diagonal opposed corners of said respective slide hubs.

5. A facial and mouth exerciser as defined in claim 4 and including a diagonal slot formed adjacent a corner of said respective slide hubs for defining a seat for retaining said elastic band in position about said slide hubs.

6. A facial and mouth exerciser as defined in claim 5 wherein each of said components are molded entirely of a plastic material to form an integral component.

7. A facial and mouth muscle exerciser comprising:

a pair of identically formed components, each of said components including an elongated shaft, a slide hub connected to one end of said shaft, and a U-shaped end piece connected to the other end of said shaft, said slide hub being generally rectangular and having a reduced lateral extension directed to one side of said shaft, a through bore extending through said lateral extension, said bore being disposed in spaced parallel relationship to the longitudinal axis of said shaft whereby the shaft of one of said components is slidably received within the bore of the slide hub of the other of said components so that said pair of components are permanently secured to one another and reciprocally mounted relative to one another for movement between a retracted and extended position, and means for imparting a resistive force on said components to be overcome when shifted from the extended position to the retracted position, wherein said resistive means comprises a coil spring disposed about each of said shafts between said slide hub and corresponding end piece of said respective components for normally biasing said slide hubs toward one another.

* * * * *